US011660870B2

(12) United States Patent
Morikoshi

(10) Patent No.: US 11,660,870 B2
(45) Date of Patent: May 30, 2023

(54) LIQUID EJECTING APPARATUS AND WIPING METHOD OF LIQUID EJECTING APPARATUS

(71) Applicant: Seiko Epson Corporation, Tokyo (JP)

(72) Inventor: Koji Morikoshi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/481,920

(22) Filed: Sep. 22, 2021

(65) Prior Publication Data

US 2022/0097384 A1 Mar. 31, 2022

(30) Foreign Application Priority Data

Sep. 25, 2020 (JP) ..... JP2020-161006

(51) Int. Cl.
*B41J 2/165* (2006.01)

(52) U.S. Cl.
CPC ..... *B41J 2/16544* (2013.01); *B41J 2/16535* (2013.01); *B41J 2/16538* (2013.01); *B41J 2/16508* (2013.01)

(58) Field of Classification Search
CPC ..... B41J 2/16544; B41J 2/16535; B41J 2/16538; B41J 2/16508
See application file for complete search history.

(56) References Cited

U.S. PATENT DOCUMENTS 7,766,450 B2 * 8/2010 Nishizaki ..... B41J 2/16508 347/29
2017/0100938 A1 4/2017 Muto

FOREIGN PATENT DOCUMENTS

| | | |
|---|---|---|
| JP | 2010-228151 | 10/2010 |
| JP | 2011-156813 | 8/2011 |
| JP | 2016-190501 | 11/2016 |
| JP | 2017-071200 | 4/2017 |
| JP | 2019-025656 | 2/2019 |
| JP | 2019-072949 | 5/2019 |

* cited by examiner

*Primary Examiner* — Geoffrey S Mruk
(74) *Attorney, Agent, or Firm* — Workman Nydegger

(57) ABSTRACT

A liquid ejecting apparatus includes: a liquid ejecting head including a wiped surface that includes a first region including nozzles and a second region outside the first region; and a wiping mechanism that wipes the wiped surface, in which a first wiping operation in which the wiping mechanism moves relative to the wiped surface in a first direction to thereby wipe the first region and the second region is performed, and a second wiping operation in which, before the first wiping operation, the wiping mechanism moves relative to the wiped surface in a direction different from the first direction to thereby wipe a region including an upstream portion of the second region, the upstream portion being arranged, with respect to the first region, in a second direction opposite to the first direction, is performed.

7 Claims, 12 Drawing Sheets

LIQUID EJECTING APPARATUS AND WIPING METHOD OF LIQUID EJECTING APPARATUS

The present application is based on, and claims priority from JP Application Serial Number 2020-161006, filed Sep. 25, 2020, the disclosure of which is hereby incorporated by reference herein in its entirety.

BACKGROUND

1. Technical Field

The present disclosure relates to a liquid ejecting apparatus for ejecting liquid from a nozzle and a wiping method of the liquid ejecting apparatus and relates particularly to an ink jet recording apparatus for ejecting ink, which is an example of a liquid, and a wiping method of the ink jet recording apparatus.

2. Related Art

As liquid ejecting apparatuses that eject liquid onto an ejection target medium, ink jet recording apparatuses that eject ink, which is an example of a liquid, to perform printing on an ejection target medium (recording target medium) such as paper or a recording sheet have been known.

Since an ink jet recording head mounted on such an ink jet recording apparatus ejects ink droplets from a nozzle, ink adheres in the vicinity of the nozzle, or the ink adhering in the vicinity of the nozzle increases in viscosity, causing a problem of an inconsistent ejection trajectory during ejection of ink droplets or a problem of an ejection failure, such as failed ejection of ink droplets.

Thus, some ink jet recording apparatuses regularly perform maintenance by wiping a nozzle surface of an ink jet recording head, on which nozzles are provided, by using a wiping member (refer to JP-A-2011-156813, for example). In the disclosure according to JP-A-2011-156813, the wiping member is moved, with respect to the nozzle surface which is a wiped surface to be wiped, in a direction from one end of the nozzle surface to the other end to thereby scrape ink or the like adhering to the nozzle surface.

Here, not only liquid ink but also a foreign substance such as paper powder or dust, or solidified ink, may adhere to the wiped surface. Such a foreign substance readily adheres particularly to the outer peripheral portion of the wiped surface. Thus, when the wiping member is moved in a direction from one end of the wiped surface to the other end to thereby wipe the wiped surface as described in JP-A-2011-156813, the wiping member may encounter a foreign substance adhering to the outer peripheral portion of the wiped surface, and the foreign substance may damage a region of the wiped surface in which a nozzle is open, resulting in a potential problem of an inconsistent ejection trajectory during ejection of ink droplets.

Ink jet recording apparatuses have such a problem, and liquid ejecting apparatuses that eject liquid other than ink have a similar problem.

SUMMARY

An aspect of the disclosure to address the aforementioned problem provides a liquid ejecting apparatus including: a liquid ejecting head including a wiped surface that includes a first region including a plurality of nozzles which eject liquid and a second region outside the first region; and a wiping mechanism that wipes the wiped surface, in which a first wiping operation in which the wiping mechanism moves relative to the wiped surface in a first direction to thereby wipe the first region and the second region is performed, and a second wiping operation in which, before the first wiping operation, the wiping mechanism moves relative to the wiped surface in a direction different from the first direction to thereby wipe a region including an upstream portion of the second region, the upstream portion being arranged, with respect to the first region, in a second direction opposite to the first direction, is performed.

Moreover, another aspect of the disclosure provides a wiping method of a liquid ejecting apparatus that includes a liquid ejecting head including a wiped surface that includes a first region including a plurality of nozzles which eject liquid and a second region positioned outside the first region and a wiping mechanism that wipes the wiped surface, and the wiping method includes performing a first wiping operation in which the wiping mechanism is moved relative to the wiped surface in a first direction to thereby wipe the first region and the second region of the liquid ejecting head and a second wiping operation in which, before the first wiping operation, the wiping mechanism is moved relative to the wiped surface in a direction different from the first direction to thereby wipe a region including an upstream portion of the second region, the upstream portion being arranged, with respect to the first region, in a second direction opposite to the first direction.

DESCRIPTION OF EXEMPLARY EMBODIMENTS

Figure 1:
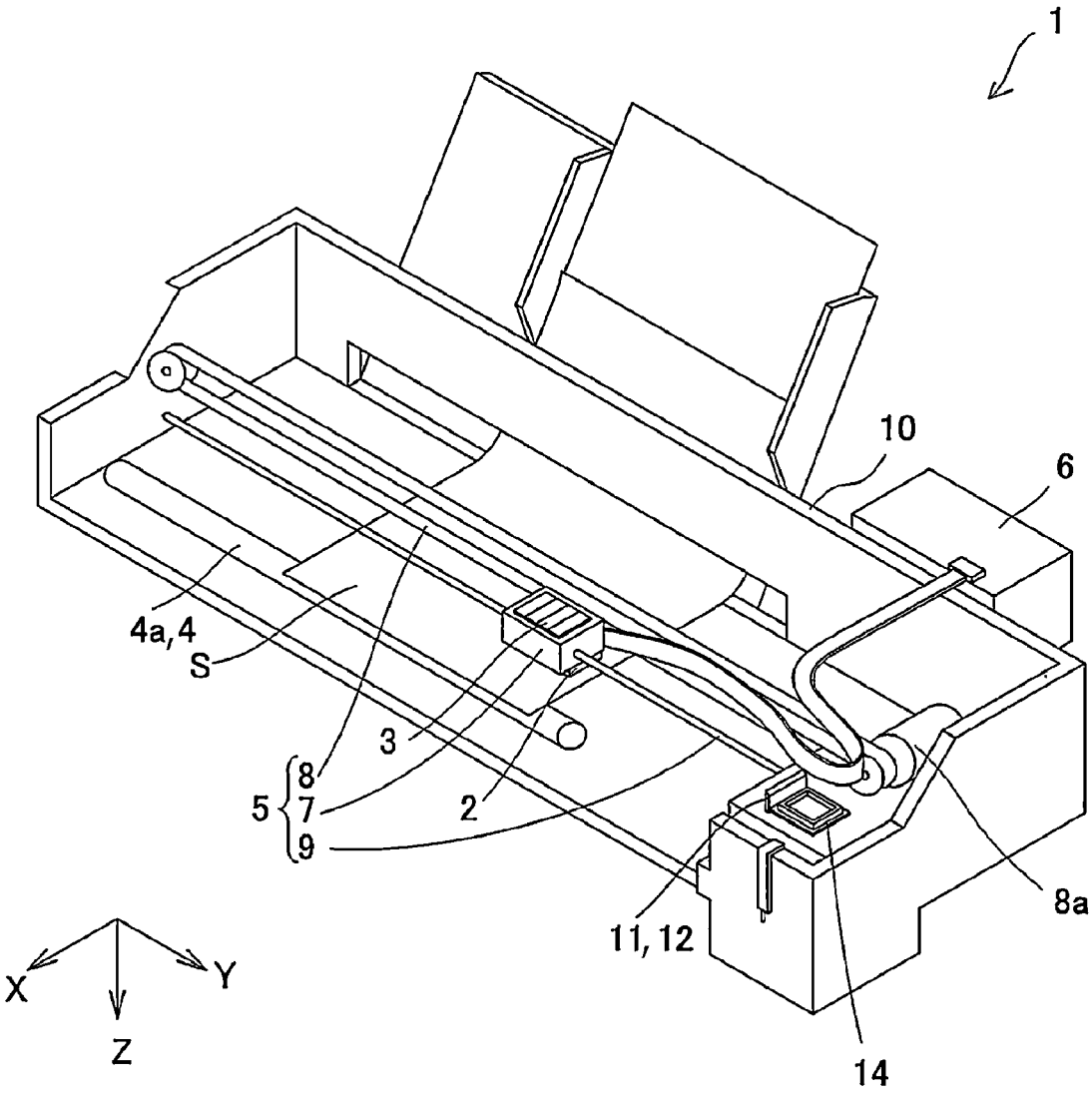
FIG. 1 is a perspective view for schematically explaining a configuration of a recording apparatus according to Embodiment 1.

Embodiments of the disclosure will be described below in detail with reference to the drawings. Note that configurations described below are merely aspects of the disclosure and can be freely modified within the scope of the disclosure. Moreover, the same reference numeral will be given to the same member in the drawings, and redundant description will be omitted.

Moreover, in the drawings, X, Y, and Z indicate three spatial axes orthogonal to each other. In the present application, directions extending along the X-axis, the Y-axis, and the Z-axis are the X direction, the Y direction, and the Z direction, respectively. In the description, the direction of an arrow in each drawing denotes a positive (+) direction, and a direction opposite to the direction of the arrow denotes a negative (−) direction.

Embodiment 1

Figure 2:
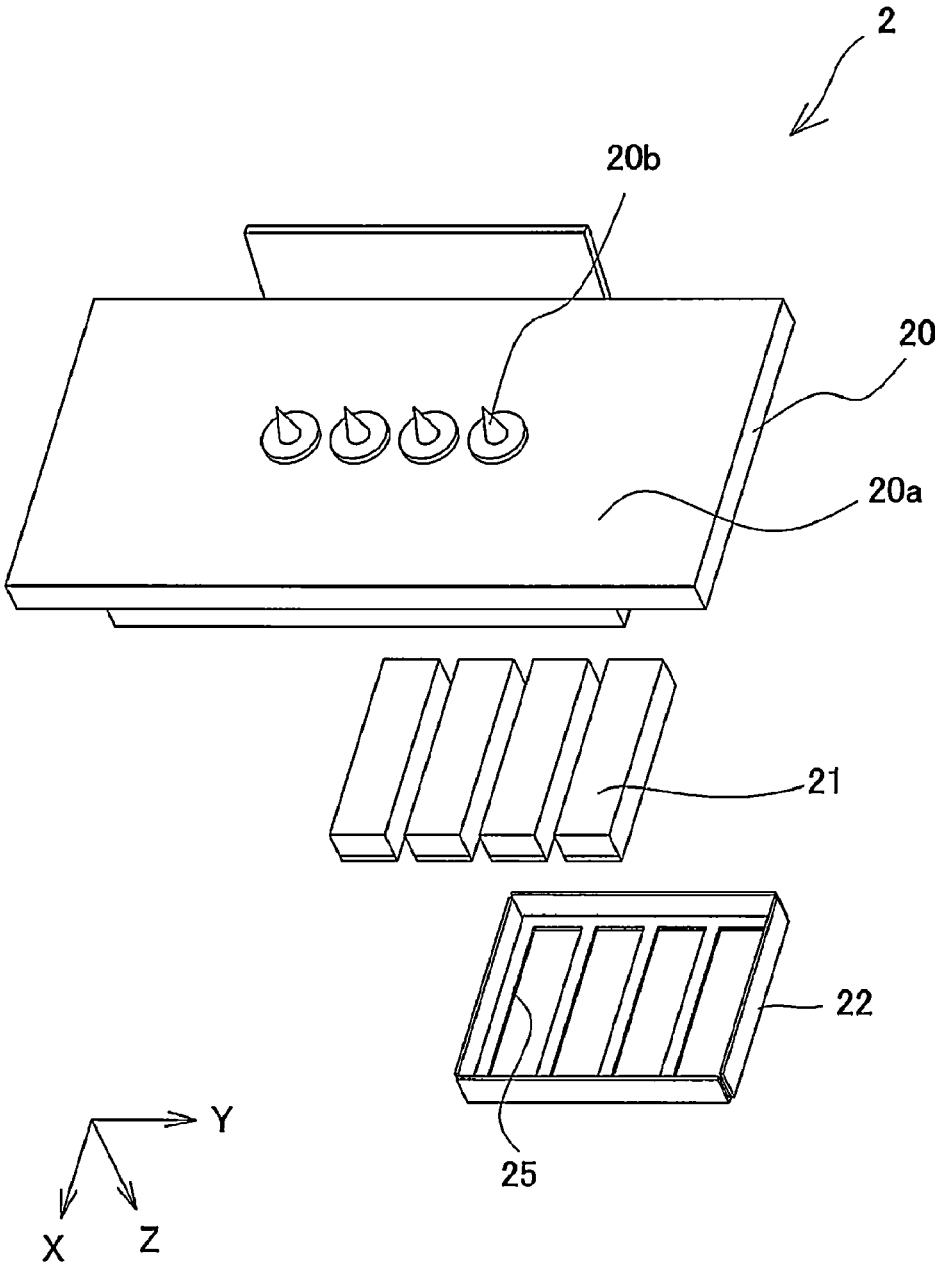
FIG. 2 is an exploded perspective view for schematically explaining a configuration of a recording head according to Embodiment 1.
Figure 3:
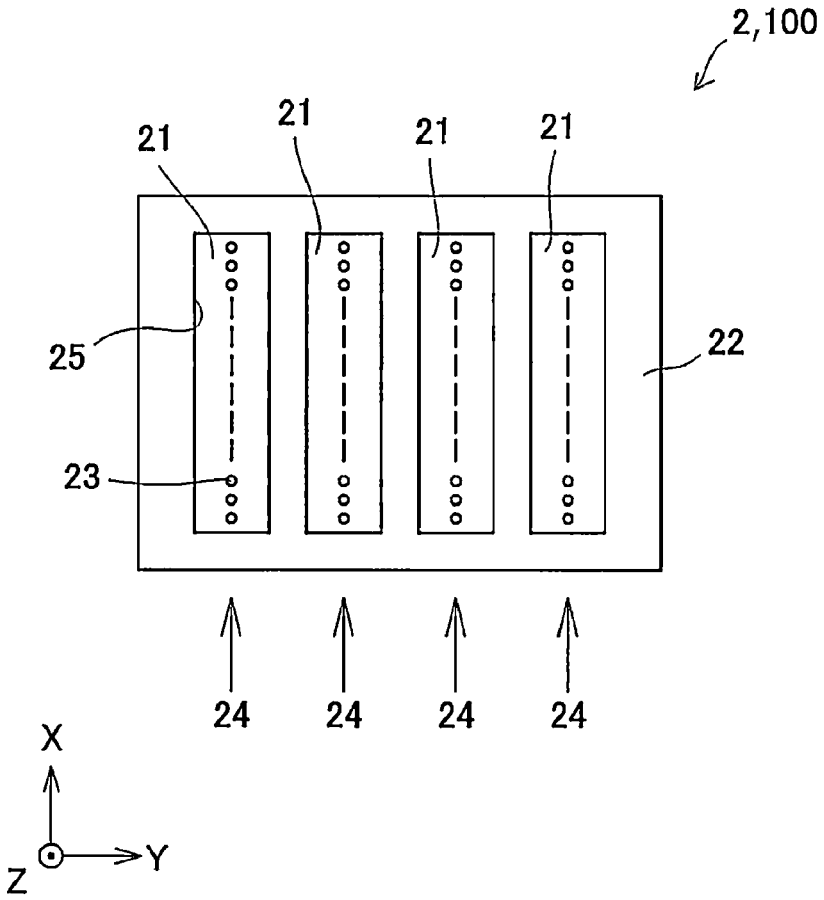
FIG. 3 is a plan view illustrating a wiped surface of the recording head according to Embodiment 1.
Figure 4:
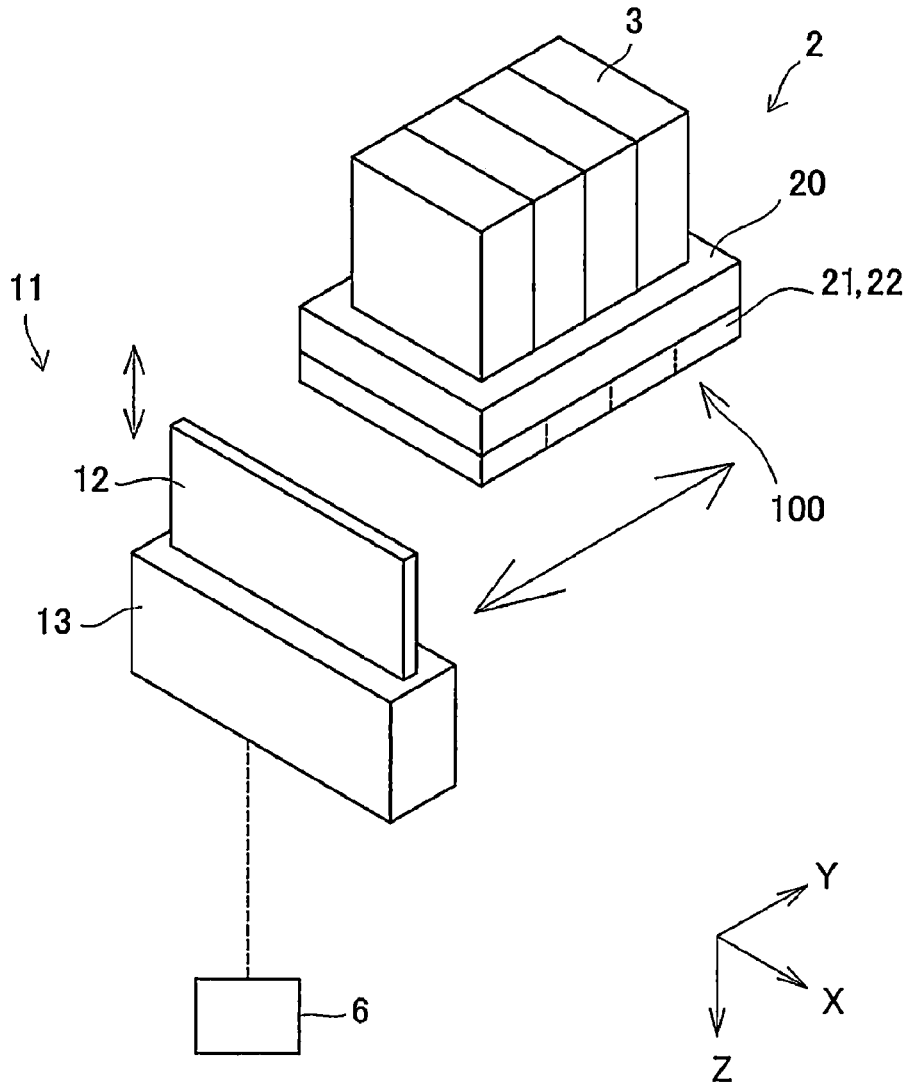
FIG. 4 is a schematic view illustrating a schematic configuration of a wiping mechanism according to Embodiment 1.
Figure 5:
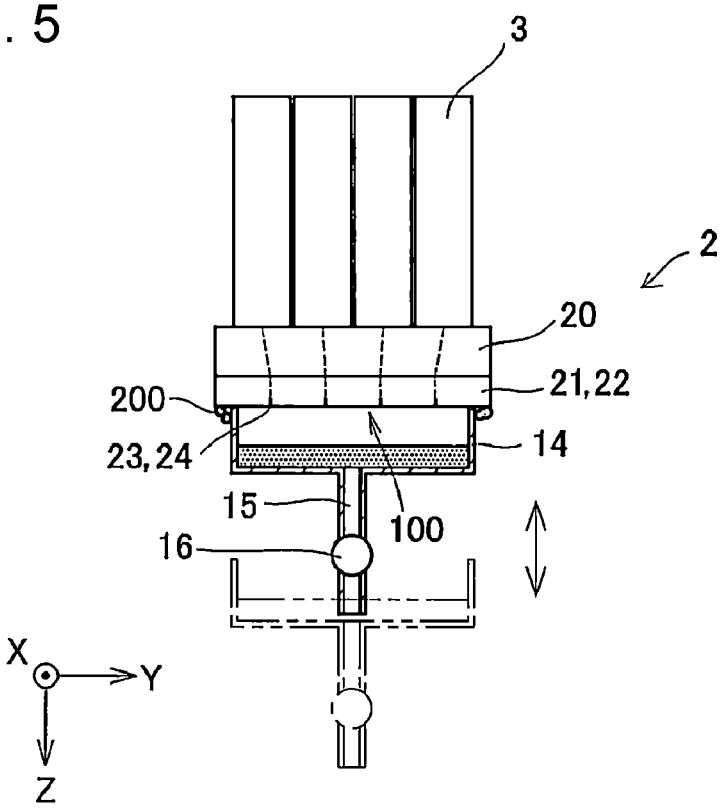
FIG. 5 is a view for explaining a configuration of a cap provided in the recording apparatus according to Embodiment 1.
Figure 6:
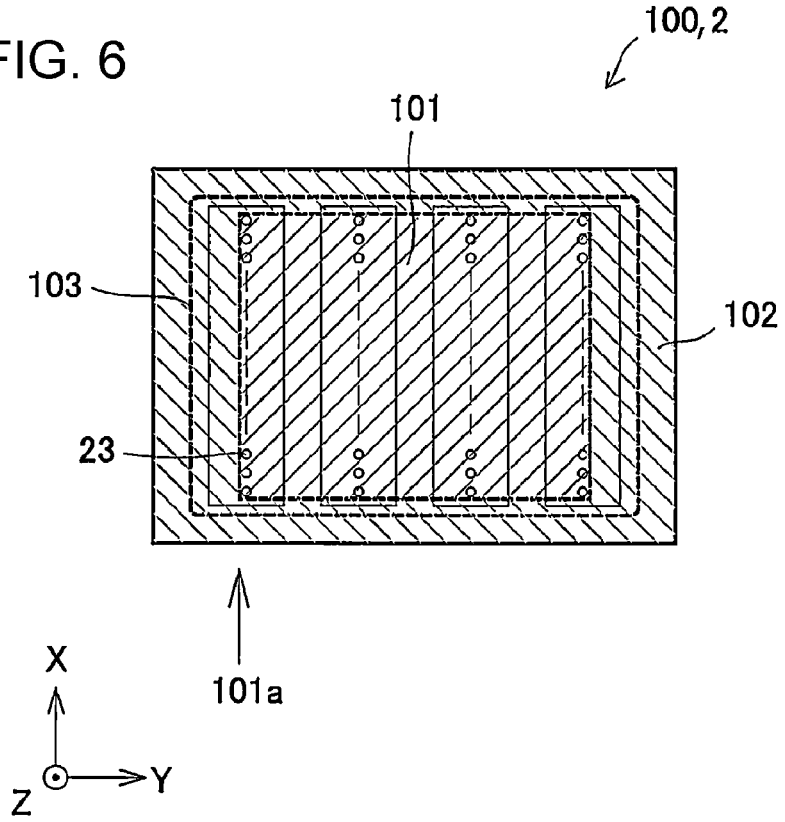
FIG. 6 is a plan view for explaining the wiped surface of the recording head according to Embodiment 1.

FIG. 1 schematically illustrates an ink jet recording apparatus which is an example of a liquid ejecting apparatus according to Embodiment 1 of the disclosure. FIG. 2 is an exploded perspective view of an ink jet recording head which is an example of a liquid ejecting head according to Embodiment 1 of the disclosure. FIG. 3 is a plan view illustrating a wiped surface of the ink jet recording head according to Embodiment 1. FIG. 4 is a schematic view illustrating a schematic configuration of a wiping mechanism provided in the ink jet recording head. FIG. 5 is a view for schematically explaining a configuration of a cap provided in the ink jet recording apparatus. FIG. 6 is a plan view for explaining the wiped surface of the ink jet recording head according to Embodiment 1.

As illustrated in FIG. 1, an ink jet recording apparatus 1, which is an example of the liquid ejecting apparatus, is a printing apparatus that includes an ink jet recording head (hereafter, simply referred to as recording head) 2, which is an example of the liquid ejecting head, that ejects ink, which is a liquid, as ink droplets, and that causes the ink to be deposited on an ejection target medium S (hereafter, referred to as medium S) such as a printing sheet to perform printing of an image or the like by forming an array of dots on the medium S. Note that, in addition to a recording sheet, any material, such as a resin film or fabric, may be used as the medium S.

Note that, in the following description, among the X direction, the Y direction, and the Z direction, a moving direction (main scanning direction) of the recording head 2 is the Y direction, and a transporting direction of the medium S, which is orthogonal to the main scanning direction, is the X direction. Moreover, a plane parallel to a nozzle surface in which nozzles of the recording head 2 are open is the XY plane, a direction intersecting the XY plane is the Z direction, and ink droplets are ejected in the +Z direction. In the present embodiment, the Z direction is orthogonal to the XY plane.

The ink jet recording apparatus 1 includes the recording head 2 and a liquid container 3, a transporting mechanism 4, a moving mechanism 5, and a control unit 6 serving as a control section.

The liquid container 3 accumulates ink to be ejected from the recording head 2. Examples of the liquid container 3 include a cartridge which is detachably attached to the ink jet recording apparatus 1, a bag-like ink pack formed from a flexible film, and an ink container which is able to be replenished with ink. In the present embodiment, a cartridge detachably attached to the recording head 2 is adopted as the liquid container 3. Moreover, each of a plurality of the liquid containers 3 accumulates a respective color of ink or a respective kind of ink.

The transporting mechanism 4 transports the medium S in the +X direction and includes, for example, a transporting roller 4*a*. Note that the transporting mechanism 4 is not limited to transporting the medium S by using the transporting roller 4*a* and may transport the medium S by using a belt or a drum.

The moving mechanism 5 reciprocates the recording head 2 in the Y direction. The Y direction in which the recording head 2 is reciprocated by the moving mechanism 5 is a direction orthogonal to the X direction in which the medium S is transported. The moving mechanism 5 of the present embodiment includes a transporting body 7, a transporting belt 8, a drive motor 8*a*, and a guide rail 9. The transporting body 7 is a substantially box-shaped structure which accommodates the recording head 2, that is, a carriage, and is fixed to the transporting belt 8. The transporting belt 8 is an endless belt extending in the Y direction and is rotated by a driving force of the drive motor 8*a*. When the transporting belt 8 rotates, the recording head 2 is reciprocated together with the transporting body 7 along the guide rail 9 extending in the Y direction. Note that the liquid container 3 may be mounted in an apparatus main body 10 separately from the recording head 2.

The control unit 6 includes a control device such as a central processing unit (CPU) or a field programmable gate array (FPGA) and a storage device such as semiconductor memory. The control unit 6 causes the control device to execute a program stored in the storage device and thereby performs overall control of the respective elements of the ink jet recording apparatus 1, that is, the recording head 2, the transporting mechanism 4, the moving mechanism 5, and the like.

As illustrated in FIG. 2, the recording head 2 includes a holding member 20, a plurality of driving sections 21, and a cover head 22.

The holding member 20 includes, on the surface on the −Z side, a liquid container attachment section 20*a* to which the liquid container 3 formed of an ink cartridge is attached. The liquid container attachment section 20*a* is provided with a coupling section 20*b* attached to the liquid container 3. In the present embodiment, a needle-shaped protrusion to be inserted into the liquid container 3 is used as the coupling section 20*b*. In the tip end of the coupling section 20*b* on the −Z side, a channel (not illustrated) provided in the holding member 20 is open. Note that a filter that captures a foreign substance or air bubbles contained in the ink may be provided in the holding member 20.

The plurality of driving sections 21 that eject ink, which is an example of a liquid, are fixed to the surface of the holding member 20 on the +Z side. In the present embodiment, the single recording head 2 includes four driving sections 21. As illustrated in FIG. 3, nozzles 23 from which liquid ink is ejected as ink droplets are provided on the surface of each of the driving sections 21 on the +Z side. A nozzle row 24 in which the plurality of nozzles 23 are arrayed in the X direction is provided in each of the driving sections 21. Since the recording head 2 is provided with the four driving sections 21, four nozzle rows 24 are provided in total. Moreover, the plurality of driving sections 21 are arranged such that the nozzles 23 constituting the nozzle rows 24 are positioned such that corresponding nozzles 23 of the respective nozzle rows 24 are positioned in the same manner in the Y direction. Note that illustration of the holding member 20 is omitted in FIG. 3.

Although one nozzle row 24 is provided in one driving section 21 in the present embodiment, the number of nozzle rows 24 formed in one driving section 21 is not particularly limited and may be, for example, two or more. Moreover, the nozzle row 24 provided in the driving section 21 is not limited to being formed by the nozzles 23 arrayed in the X direction and may be formed by the nozzles 23 inclined with respect to the X direction and the Y direction in the XY plane, which is within the nozzle surface in which the nozzles 23 are open.

Although illustration is omitted, a plurality of channels, each of which communicates with a corresponding one of the nozzles 23, and a pressure generating unit which causes a change in pressure of ink in the channels are provided in the driving section 21. The pressure generating unit may be, for example, one that changes a capacity of a liquid channel by deforming a piezoelectric actuator containing a piezoelectric material which exhibits an electromechanical conversion function and that causes a change in pressure of ink in the liquid channel to thereby eject ink droplets from the nozzles 23.

The pressure generating unit may be, for example, one in which a heating element is arranged in a channel and in which ink droplets are ejected from the nozzles 23 by bubbles generated by the heat of the heating element. Furthermore, as an example of the pressure generating unit, an electrostatic actuator that generates an electrostatic force between a diaphragm and an electrode and that deforms the diaphragm by using the electrostatic force to thereby eject ink droplets from the nozzles 23 may be used.

Moreover, the recording head 2 includes the cover head 22 on the +Z side. The cover head 22 protects the nozzle surface side on which the nozzles 23 of the plurality of the driving sections 21 are open. Note that the nozzle surface is the surface of the recording head 2, on which the nozzles 23 for ejecting ink are open, and the cover head 22 is provided with openings 25, each of which exposes a corresponding one of nozzle rows 24 of the driving sections 21. In the present embodiment, four openings 25 corresponding to the four driving sections 21 are provided in the cover head 22 so as to be arrayed side by side in the Y direction.

Furthermore, the ink jet recording apparatus 1 includes a wiping mechanism 11 that wipes a wiped surface 100 of the recording head 2 in a region on either side of the Y direction which is the main scanning direction of the recording head 2, that is, a region on the +Y side in the present embodiment. Here, the wiped surface 100 is one surface of the recording head 2 which is to be wiped by the wiping mechanism 11. In the present embodiment, a surface that includes the nozzle surface on which nozzles 23 of each of the driving sections 21 provided in the recording head 2 are open and that includes the +Z-side surface of the cover head 22, which protects the nozzle surface, is the wiped surface 100.

As illustrated in FIG. 4, the wiping mechanism 11 includes a wiper 12 as a wiping member and a raising/lowering device 13 that raises/lowers the wiper 12. The wiper 12 is formed of a plate-shaped elastic member, such as a member made of rubber or an elastomer, and is formed to be wider than the wiped surface 100 of the recording head 2 in the X direction. The raising/lowering device 13 includes a driving unit such as a motor and raises/lowers the wiper 12 between a first position (refer to FIG. 7) at which the wiper 12 is not in contact with the wiped surface 100 and a second position (refer to FIG. 8) which is higher than the first position and at which the wiper 12 is in contact with the wiped surface 100.

Although description will be given later in detail, in a wiping operation of wiping the wiped surface 100 of the recording head 2, the wiper 12 is moved relative to the recording head 2 in a state in which the tip end portion of the wiper 12 is in contact with the wiped surface 100, thereby wiping the wiped surface 100 of the recording head 2.

Note that the wiper 12 which is the wiping member for wiping the wiped surface 100 is not limited to being formed of a plate-shaped elastic member or the like and may be formed of, for example, a porous material such as sponge, woven fabric, or nonwoven fabric.

Moreover, on the +Y side of the wiper 12, which is a home position at which the transporting body 7 stands by, a cap 14 is disposed so as to be adjacent to the wiper 12 (refer to FIG. 1). The cap 14 is configured to be able to be raised/lowered and is formed to have a tray shape which can be in contact with the wiped surface 100 of the recording head 2 as illustrated in FIG. 5. A space in the cap 14 functions as a sealed space, and the cap 14 is configured to be able to be in close contact with the wiped surface 100 in a state in which the nozzles 23 of the recording head 2 face the interior of the sealed space. Moreover, a pump 16 is coupled to the cap 14 via a waste-liquid tube 15, and driving of the pump 16 enables the pressure in the sealed space of the cap 14 to be negative.

In this manner, by bringing the cap 14 into contact with the wiped surface 100 to close the nozzles 23 of the recoding head 2, it is possible to suppress an increase in viscosity of ink in the vicinity of the nozzle 23 and suppress an occurrence of nozzle clogging or the like.

Meanwhile, a foreign substance, such as paper powder or dust, may adhere to the wiped surface 100 of the recording head 2. By bringing the cap 14 into contact with the wiped surface 100, it is possible to suppress a foreign substance from adhering to a portion of the wiped surface 100 which is covered with the cap 14. However, even when the cap 14 is brought into contact with the wiped surface 100, a foreign substance 200 may adhere to the outer peripheral portion of the wiped surface 100, that is, a portion of the wiped surface 100 which is not covered with the cap 14.

Furthermore, when a sealing section 103 (refer to FIG. 6) of the wiped surface 100, which comes into contact with the cap 14 and which will be described later, repeatedly separates from and comes into contact with the edge of the cap 14 in a state in which ink adheres to the sealing section 103, a constituent, such as pigment, which is contained in the ink may condense and accumulate, resulting in the foreign substance 200 adhering to the sealing section 103.

In this manner, after the foreign substance 200 adheres to the outer peripheral portion of the wiped surface 100, when the cap 14 is detached from the wiped surface 100 of the recording head 2 and the wiper 12 is moved from one end of the wiped surface 100 to wipe the wiped surface 100, the wiper 12 may encounter the foreign substance 200, and, for example, the foreign substance 200 may damage the nozzle 23 or may be driven into the nozzle 23, resulting in an ejection failure.

However, as described below, according to the ink jet recording apparatus 1 of the disclosure, it is possible to suppress an ejection failure resulting from the foreign substance 200 adhering to the surface of the wiped surface 100, particularly, the outer peripheral portion of the wiped surface 100, from occurring.

Here, as illustrated in FIG. 6, the wiped surface 100 of the recording head 2 is assumed to include a first region 101 that includes the nozzles 23 of the recording head 2 and a second region 102 outside the first region 101. The first region 101 is a region demarcated by straight lines such that the first region 101 includes all the nozzles 23 of the driving sections 21 and has the smallest area. The second region 102 is a region outside the first region 101, that is, a region of the outer peripheral portion of the wiped surface 100. In other words, the second region 102 is a portion of the wiped surface 100 excluding the first region 101 and is a region continuous to the periphery of the first region 101.

The cap 14 described above comes into contact with the second region 102 of the wiped surface 100 and thereby suppresses each of the nozzles 23 from, for example, drying. As illustrated in FIG. 6, the cap 14 comes into contact with the wiped surface 100 at the sealing section 103 positioned in the second region 102, and a region inside the sealing section 103 is a sealed region sealed by the cap 14.

When the wiping operation of wiping the wiped surface 100 of the recording head 2 is performed, the following operations are performed: a first wiping operation in which the wiping mechanism 11 moves relative to the wiped surface 100 in the +Y direction, which is a first direction, to thereby wipe the first region 101 and the second region 102; and a second wiping operation in which, immediately before the first wiping operation, the wiping mechanism 11 moves relative to the wiped surface 100 in a direction different from the +Y direction, which is the first direction, to thereby wipe a region including an upstream portion of the second region 102, the upstream portion being arranged, with respect to the first region 101, in a second direction opposite to the +Y direction, which is the first direction.

In the first wiping operation, which is a main wiping operation, the wiper 12 provided in the wiping mechanism 11 moves relative to the recording head 2 in the +Y direction, which is the first direction, and thereby wipes the first region 101 and the second region 102 of the wiped surface 100. In the present embodiment, when the recording head 2 is moved in the −Y direction by the moving mechanism 5, the wiper 12 is moved relative to the recording head 2 in the +Y direction. That is, in the configuration of the present embodiment, the moving mechanism 5 functions also as a portion of the wiping mechanism 11.

In the second wiping operation, which is a pre-wiping operation, the wiper 12 provided in the wiping mechanism 11 moves relative to the recording head 2 in a direction different from the first direction, in the present embodiment, the −Y direction, which is the second direction, and thereby wipes the region including the upstream portion of the second region 102, the upstream portion being arranged in the −Y direction, which is the second direction.

Here, the upstream portion of the second region 102, the upstream portion being arranged in the second direction, is, in the second region 102 surrounding the periphery of the first region 101, a portion upstream in the moving direction of the wiper 12 in the first wiping operation, which is the main wiping operation. In a case of the wiped surface 100 illustrated in FIG. 6, a portion of the second region 102 which is on the −Y direction side with respect to an end portion 101*a* of the first region 101 corresponds to the upstream portion of the second region 102, the upstream portion being arranged in the second direction. Moreover, in the second wiping operation, only a region outside the first region 101, in the present embodiment, the second region 102, is wiped. That is, in the second wiping operation, the first region 101 is not wiped. Needless to say, a region including a portion of the first region 101 may be wiped together with the second region 102. That is, in the second wiping operation, wiping may be started from the +Y direction side of the end portion 101*a* of the first region 101.

As described above, for example, when performing the first wiping operation by detaching the cap 14 from the wiped surface 100 and using the wiping mechanism 11, the ink jet recording apparatus 1 according to the disclosure performs the second wiping operation, which is the pre-wiping operation, before, desirably immediately before, performing the first wiping operation. This makes it possible to suppress the wiper 12 from encountering the foreign substance 200 at the time of the main wiping operation and to suppress an ejection failure resulting from encountering the foreign substance 200 from occurring.

Note that the first wiping operation and the second wiping operation with the wiping mechanism 11 are performed by the control unit 6 controlling the wiping mechanism 11.

FIGS. 7 to 11 are views for explaining a wiping method performed by the wiping mechanism according to Embodiment 1. An example of the method of wiping the wiped surface 100 by using the wiping mechanism 11 in accordance with control performed by the control unit 6 will be described below with reference to FIGS. 7 to 11.

Figure 7:
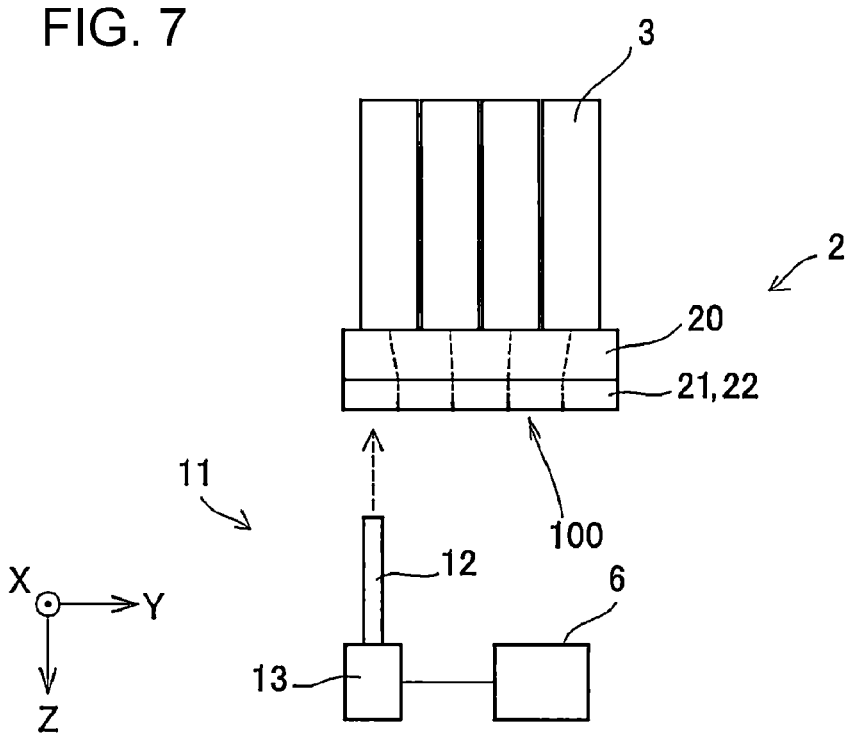
FIG. 7 is a view for explaining a wiping method of the recording apparatus according to Embodiment 1.
Figure 9:
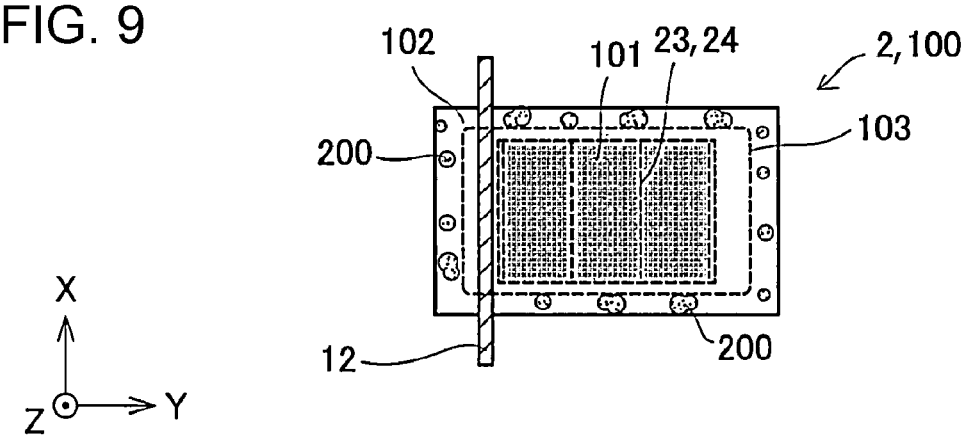
FIG. 9 is a view for explaining the wiping method of the recording apparatus according to Embodiment 1.

First, when the second wiping operation is started, as illustrated in FIGS. 7 and 9, the wiper 12 is moved relative to the recording head 2 such that the wiper 12 is at a position at which the wiper 12 faces the recording head 2. That is, the recording head 2 is moved by the moving mechanism 5 such that the wiper 12 is at the position at which the wiper 12 faces the recording head 2. Specifically, the recording head 2 is moved such that the wiper 12 faces a region of the second region 102 of the wiped surface 100, which is on the −Y direction side of the first region 101 and within the sealing section 103 with respect to the Y direction.

Figure 8:
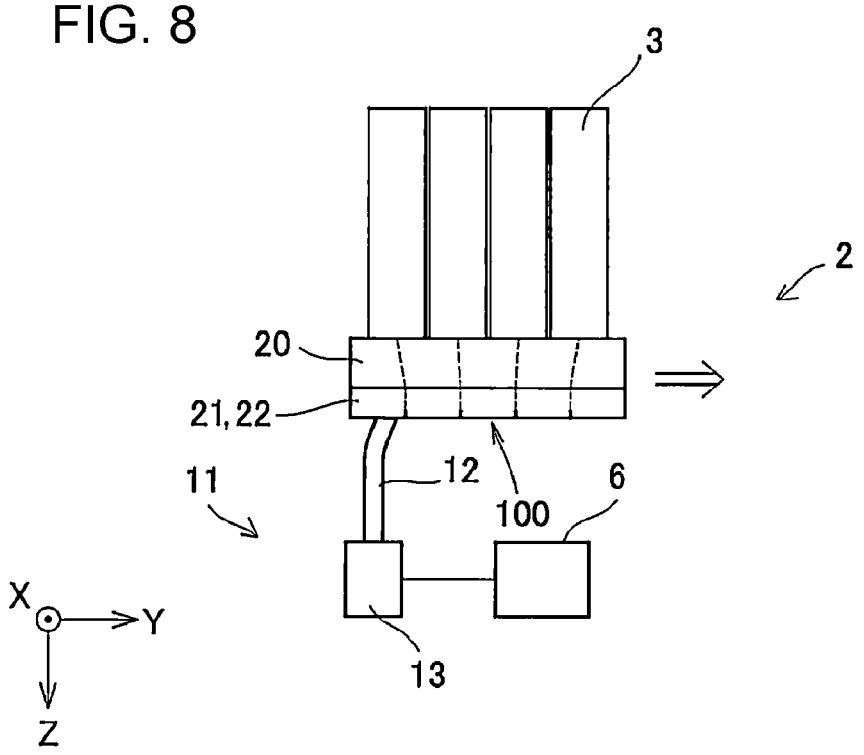
FIG. 8 is a view for explaining the wiping method of the recording apparatus according to Embodiment 1.
Figure 10:
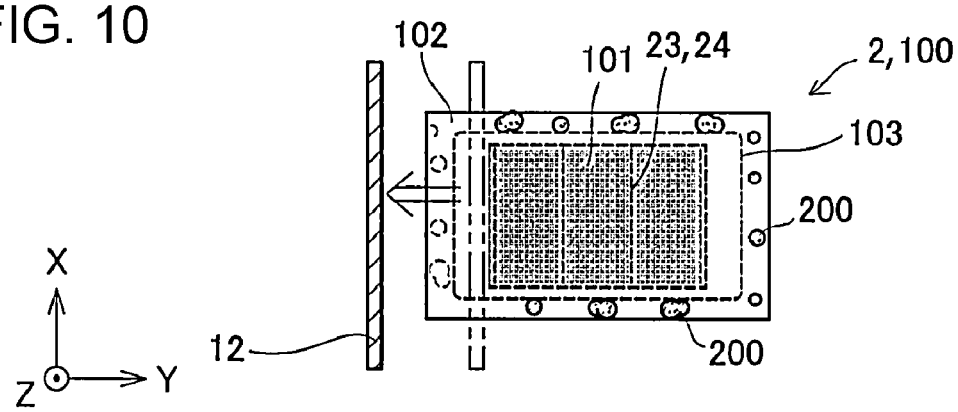
FIG. 10 is a view for explaining the wiping method of the recording apparatus according to Embodiment 1.

In this state, the wiper 12 is raised by the raising/lowering device 13, and the tip end portion of the wiper 12 is brought into contact with the wiped surface 100 as illustrated in FIG. 8. Next, the recording head 2 is moved in the +Y direction, and the wiper 12 is thereby moved relative to the wiped surface 100 to a position outside the recording head 2 as illustrated in FIG. 10. That is, the wiper 12 is moved relative to the wiped surface 100 in the −Y direction, which is the second direction, from a position within the sealing section 103 with respect to the Y direction and on the −Y direction side of the nozzles 23 to a position outside the recording head 2.

Thereby, the region including the upstream portion of the second region 102, the upstream portion being arranged in the −Y direction, which is the second direction, is wiped, and the foreign substance 200 is removed. Specifically, since the sealing section 103 is included in a portion of the upstream portion to be wiped in the second wiping operation, not only the foreign substance 200 adhering to the outer peripheral portion of the second region 102 of the wiped surface 100 which is not covered with the cap 14 but also a foreign substance adhering to the sealing section 103 is removed. Moreover, in the second wiping operation, since the wiper 12 is moved relative to the wiped surface 100 in a direction away from the first region 101 and the first region 101 is not wiped, no nozzle 23 is damaged due to the second wiping operation.

Figure 11:
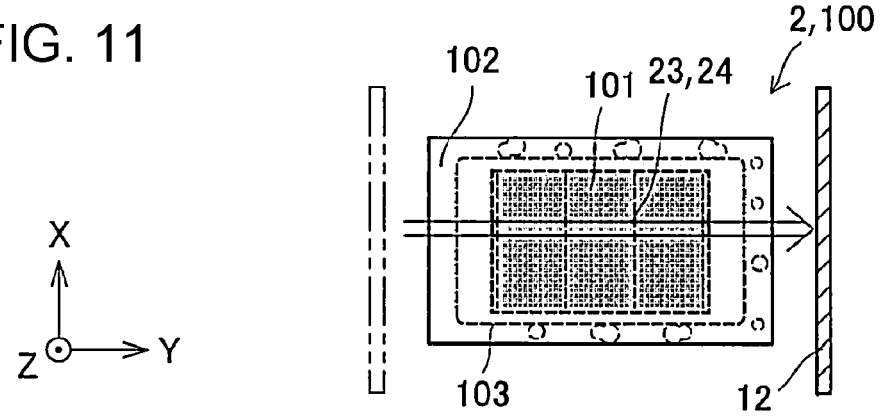
FIG. 11 is a view for explaining the wiping method of the recording apparatus according to Embodiment 1.

The first wiping operation, which is the main wiping operation, is then performed. That is, as illustrated in FIG. 11, by moving the recording head 2 in the −Y direction from a state in which the wiper 12 is positioned outside the recording head 2 in the −Y direction, the wiper 12 is moved relative to the wiped surface 100 to outside the recording head 2 in the +Y direction.

Thereby, it is possible to suppress the foreign substance 200 from being encountered in the first wiping operation and to effectively wipe the wiped surface 100 of the recording head 2. Moreover, since wiping is started from a region within the sealing section 103 in the second wiping operation, which is the pre-wiping operation, at least a region upstream of the first region 101 and outside the sealing section 103, that is, a region on the −Y direction side, is effectively wiped. Accordingly, even when the foreign substance 200 adheres to the other region of the second region 102, the foreign substance 200 is suppressed from being encountered in the first region 101 in the first wiping operation.

Moreover, in the present embodiment, the first wiping operation and the second wiping operation are performed by using a single wiper 12. That is, the wiping mechanism 11 includes the common wiper 12 used in the first wiping operation and the second wiping operation. Thus, it is possible to achieve a reduction in the number of components and, furthermore, to achieve a reduction in manufacturing costs.

Moreover, in the present embodiment, the wiper 12 is formed to be wider than the wiped surface 100 of the recording head 2 in the X direction and also wipes the second region 102 outside the first region 101 of the wiped surface 100 in the +X direction and outside the first region 101 in the −X direction. Accordingly, when the cap 14 is then brought into contact with the wiped surface 100, it is possible to improve a sealing property of the cap 14 with respect to the wiped surface 100. However, wiping the second region 102 outside the first region 101 in the +X direction and outside the first region 101 in the −X direction does not contribute to preventing the foreign substance 200 from being encountered in the first region 101 and is therefore not necessarily performed.

Moreover, in the present embodiment, since the second wiping operation, which is the pre-wiping operation, is performed for only a region upstream of a region wiped in the first wiping operation, which is the main wiping operation, the wiping operation of the wiped surface 100 is able to be finished in a relatively short time. Needless to say, a pre-wiping operation similar to the pre-wiping operation in the upstream region may be performed as necessary for a region downstream of the region wiped in the first wiping operation.

Embodiment 2

Figure 12:
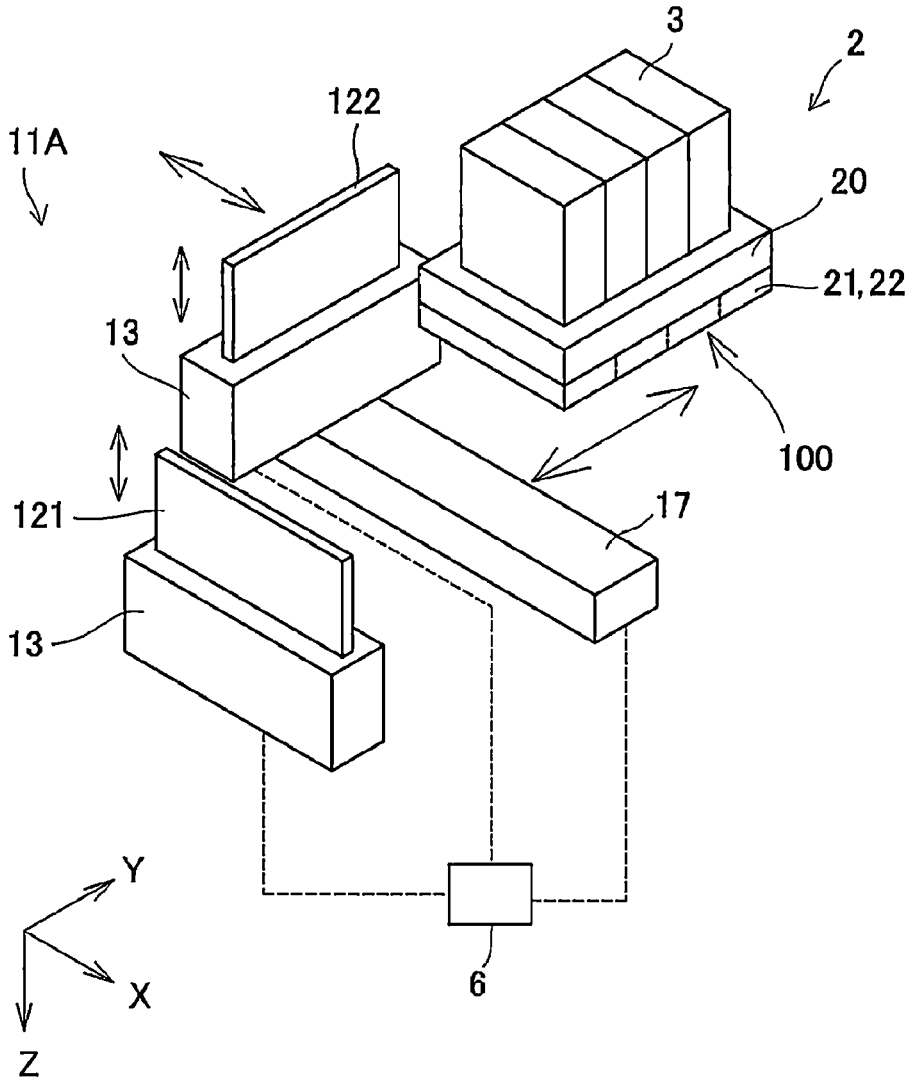
FIG. 12 is a schematic view illustrating a schematic configuration of a wiping mechanism according to Embodiment 2.
Figure 13:
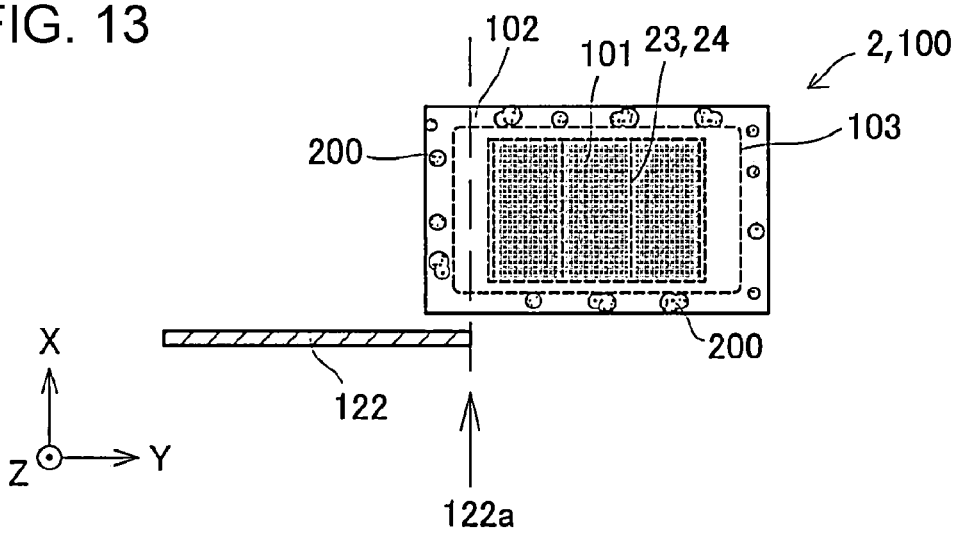
FIG. 13 is a view for explaining a wiping method performed by the wiping mechanism according to Embodiment 2.
Figure 14:
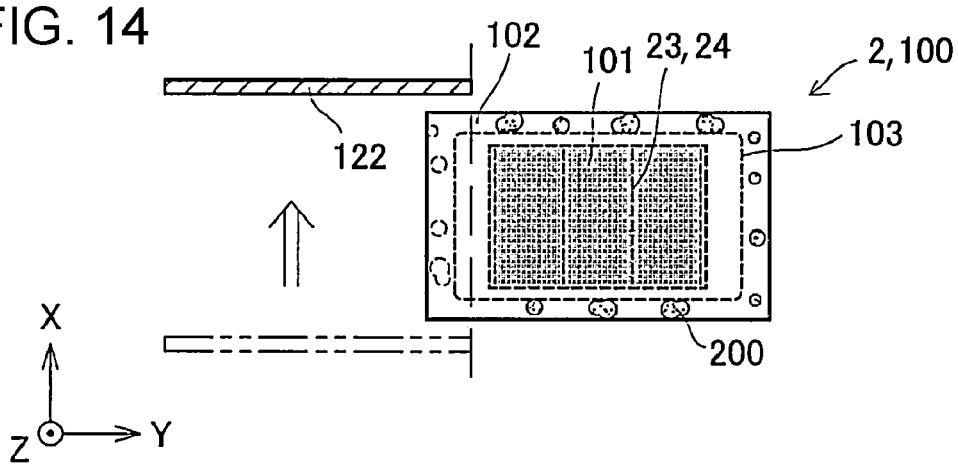
FIG. 14 is a view for explaining the wiping method performed by the wiping mechanism according to Embodiment 2.
Figure 15:
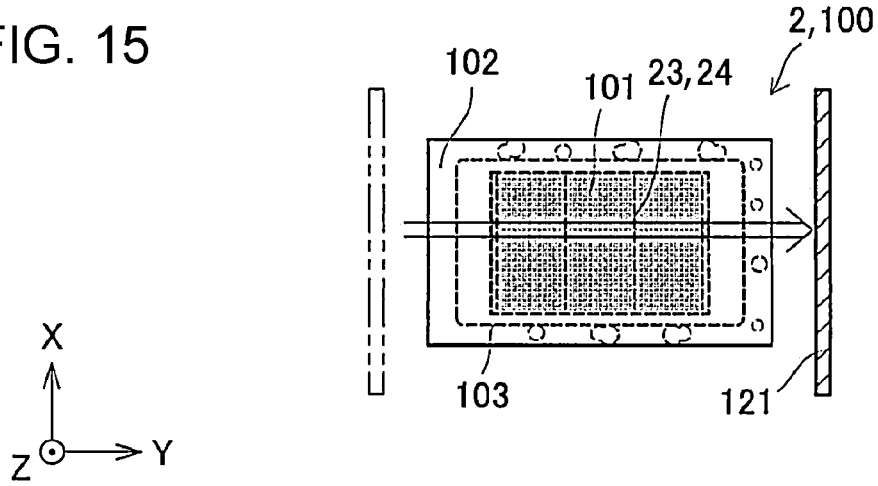
FIG. 15 is a view for explaining the wiping method performed by the wiping mechanism according to Embodiment 2.

FIG. 12 is a schematic view illustrating a schematic configuration of a wiping mechanism according to Embodiment 2, and FIGS. 13 to 15 are views for explaining a wiping method performed by the wiping mechanism according to Embodiment 2.

An ink jet recording apparatus according to the present embodiment is configured such that the wiping mechanism includes a first wiping member used in the first wiping operation and a second wiping member used in the second wiping operation and such that, in the second wiping operation, the second wiping member moves in a direction intersecting the first direction relative to a region including an upstream portion of the second region, the upstream portion being arranged, with respect to the first region, in the second direction opposite to the first direction.

Specifically, as illustrated in FIG. 12, a wiping mechanism 11A according to the present embodiment includes a first wiper 121 which is the first wiping member and a second wiper 122 which is the second wiping member. The first wiper 121 has substantially the same configuration as that of the wiper 12 in Embodiment 1, is provided to be wider than the wiped surface 100 in the X direction, and is configured to be movable relative to the recording head 2 in the Y direction. In the present embodiment, when the recording head 2 is moved in the Y direction, the first wiper 121 moves relative to the wiped surface 100 in the Y direction.

On the other hand, in the present embodiment, the second wiper 122 is formed from the same member as that of the first wiper 121 but is arranged so as to face a direction intersecting the first wiper 121, for example, a direction rotated by 90 degrees. The second wiper 122 is configured to be movable relative to the recording head 2 in the X direction which is the second direction orthogonal to the Y direction which is the first direction. The wiping mechanism 11A includes a transporting device 17 for reciprocating the second wiper 122 in the X direction. Although illustration is omitted, the transporting device 17 is configured to include a power source such as a motor and to be able to reciprocate the second wiper 122 in the X direction in response to power from the power source.

Note that, since the configuration of the transporting device 17 is not particularly limited and an existing configuration may be adopted, detailed description thereof will be omitted here. Moreover, the wiping mechanism 11A includes the raising/lowering devices 13 that raise/lower the first wiper 121 and the second wiper 122.

An example of the wiping method performed by the above-described wiping mechanism 11A of the present embodiment will be described.

First, when the second wiping operation is started, the recording head 2 is moved such that the recording head 2 is at a predetermined position with respect to the second wiper 122. Specifically, as illustrated in FIG. 13, the recording head 2 is moved such that an end portion 122*a* of the second wiper 122 on the +Y direction side is positioned in a region of the second region 102 which is on the −Y direction side of the first region 101 and which is on the +Y direction side of a portion of the sealing section 103 with which the cap 14 comes into contact, that is, which is in an internal region of the sealing section 103. At this time, the second wiper 122 is arranged at a home position outside the recording head 2 in the −X direction.

In this state, the second wiper 122 is raised by the raising/lowering device 13 to a position at which the tip end portion of the second wiper 122 comes into contact with the second region 102 of the wiped surface 100, and the second wiper 122 is moved in the +X direction by the transporting device 17 as illustrated in FIG. 14. That is, the second wiper 122 is moved from outside the recording head 2 in the −X direction to outside the recording head 2 in the +X direction.

Similarly to Embodiment 1, the first wiping operation, which is the main wiping operation, is then performed. That is, as illustrated in FIG. 15, by moving the recording head 2 in the −Y direction from a state in which the first wiper 121 is positioned outside the recording head 2 in the −Y direction, the first wiper 121 is moved relative to the wiped surface 100 to outside the recording head 2 in the +Y direction.

As described above, in the present embodiment, the region including the upstream portion of the second region 102, the upstream portion being arranged, with respect to the first region 101, in the −Y direction, which is the second direction, is wiped in the second wiping operation. Moreover, at this time, since the end portion 122*a* of the second wiper 122 is positioned on the +Y direction side of a portion of the sealing section 103, it is possible to more reliably remove a foreign substance outside the sealing section 103. Accordingly, it is possible to further suppress nozzle clogging or the like due to a foreign substance encountered at the time of the main wiping operation from occurring.

In addition, the wiping mechanism 11A according to the present embodiment includes two wipers of the first wiper 121 used in the first wiping operation and the second wiper 122 used in the second wiping operation but may include a common wiper used in the first wiping operation and the second wiping operation. That is, the wiping mechanism 11A may include a single wiper which is a wiping member, a transporting device that is able to transport the wiper in the X direction, and a rotating device that is able to rotate the wiper on the XY plane.

Furthermore, in the wiping mechanism 11A according to the present embodiment, the first wiper 121 used in the first wiping operation and the second wiper 122 used in the second wiping operation are formed of the same member but may be configured such that the width of the second wiper 122 in the Y direction is smaller than the width of the first wiper 121 in the X direction. This is because the width of the region wiped by the second wiper 122, in other words, the width of the upstream portion of the second region 102 which is a portion upstream of the first region 101, in the Y direction orthogonal to the X direction in which the second wiper 122 moves relative to the upstream portion is smaller than the width of the wiped surface 100, which is wiped by the first wiper 121, in the X direction.

Such a configuration enables a reduction in size of the wiping mechanism 11A. That is, the width of the second wiper 122 in the Y direction may be equal to or less than a distance from the end portion of the first region 101 on the −Y direction side to the end portion of the wiped surface 100 on the −Y direction side as long as the width of the second wiper 122 in the Y direction is equal to or more than a distance from the end portion of the sealing section 103 on the −Y direction side to the end portion of the wiped surface 100 on the −Y direction side.

Embodiment 3

Figure 16:
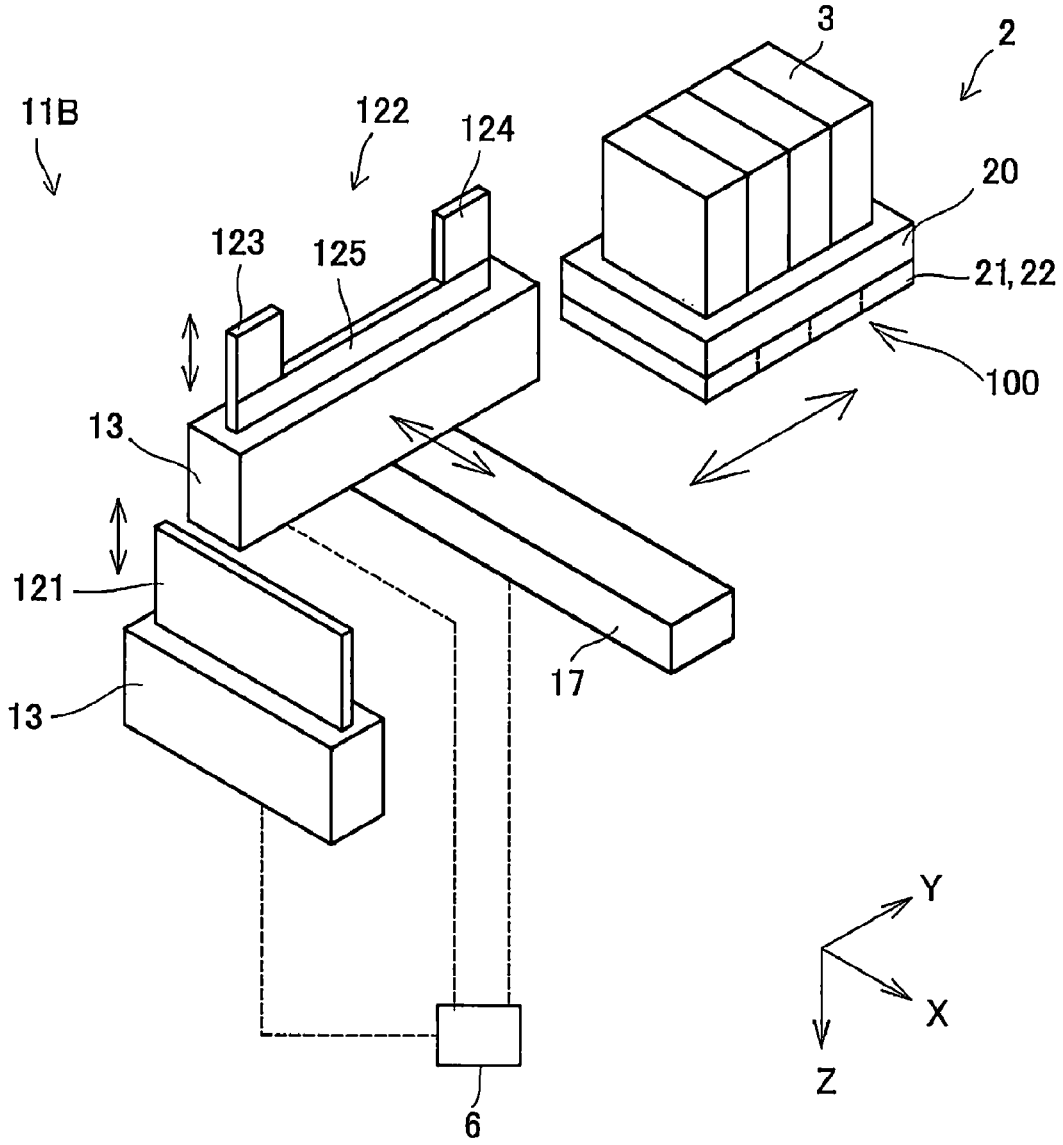
FIG. 16 is a schematic view illustrating a schematic configuration of a wiping mechanism according to Embodiment 3.
Figure 17:
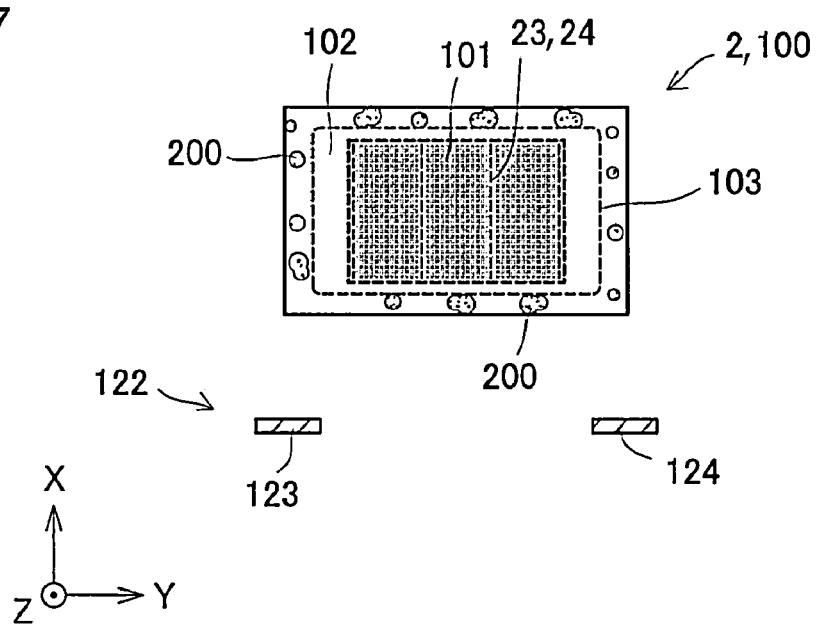
FIG. 17 is a view for explaining a wiping method of a recording apparatus according to Embodiment 3.
Figure 18:
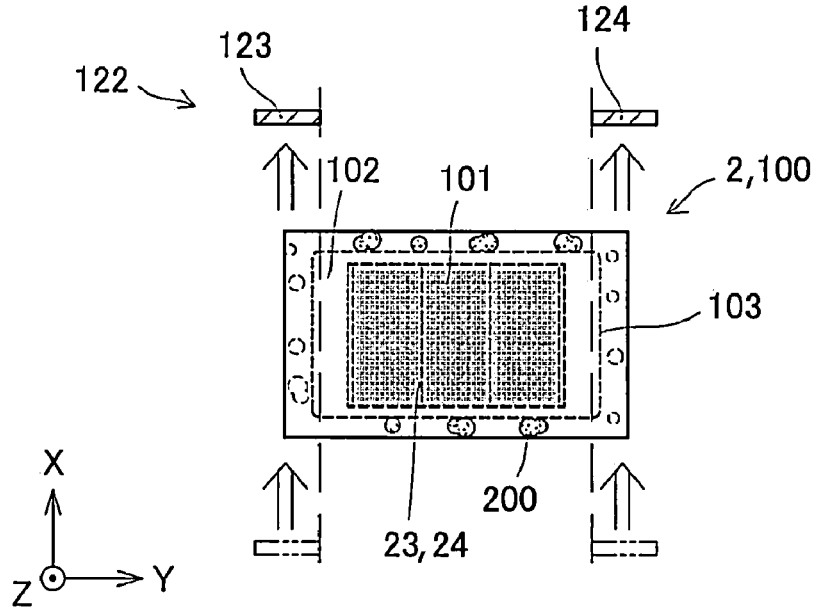
FIG. 18 is a view for explaining the wiping method of the recording apparatus according to Embodiment 3.

FIG. 16 is a schematic view illustrating a schematic configuration of a wiping mechanism of an ink jet recording apparatus according to Embodiment 3, and FIGS. 17 and 18 are views for explaining a wiping method performed by the wiping mechanism according to Embodiment 3.

As illustrated in FIG. 16, although a wiping mechanism 11B according to the present embodiment includes the first wiper 121 used in the first wiping operation and the second wiper 122 used in the second wiping operation similarly to Embodiment 2, the shape of the second wiper 122 differs from that in Embodiment 2.

Specifically, the second wiper 122 according to the present embodiment is constituted by a first blade 123 and a second blade 124 which are formed from an elastic plate-shaped member and a supporting member 125 which supports the first blade 123 and the second blade 124 in a state in which the first blade 123 and the second blade 124 are separated from each other by a predetermined gap. The gap between the first blade 123 and the second blade 124 is slightly longer than a dimension of the first region 101 of the wiped surface 100 in the Y direction.

Thus, in the second wiping operation, when the second wiper 122 is moved relative to the recording head 2 to a position at which the second wiper 122 faces the recording head 2, the first blade 123 is arranged on the −Y direction side of the first region 101 of the wiped surface 100, and the second blade 124 is arranged on the +Y direction side of the first region 101, as illustrated in FIG. 17. Accordingly, moving the second wiper 122 in such a state in the X direction by the transporting device 17 as illustrated in FIG. 18 enables not only a portion of the second region 102 upstream of the first region 101 but also a portion of the second region 102 downstream of the first region 101 to be wiped at the same time. That is, of the second region 102, a portion outside the first region 101 in the +Y direction and a portion outside the first region 101 in the −Y direction are able to be wiped at the same time.

Similarly to Embodiment 2, the first wiping operation, which is the main wiping operation, is then performed. That is, by moving the recording head 2 in the −Y direction from the state in which the first wiper 121 is positioned outside the recording head 2 in the −Y direction, the first wiper 121 is moved relative to the wiped surface 100 to outside the recording head 2 in the +Y direction (refer to FIG. 15).

Also in the above-described configuration of the present embodiment, similarly to the above-described embodiments, it is possible to suppress nozzle clogging or the like due to a foreign substance encountered at the time of the first wiping operation, which is the main wiping operation, from occurring.

Other Embodiments

Although the embodiments of the disclosure have been described above, the disclosure is not limited to the embodiments.

For example, although the configuration in which the wiped surface includes the nozzle surface, which corresponds to a surface of a nozzle plate, and the surface of the cover head has been exemplified in the above-described embodiments, the wiped surface is a surface to be wiped, and the configuration of the wiped surface is not particularly limited. For example, when the recording head includes no cover head, the wiped surface may be formed of only the nozzle surface.

Moreover, although the wiper for wiping the wiped surface is moved relative to the recording head in the Y direction by moving the recording head at the time of the wiping operation in the above-described embodiments, the configuration for moving the wiper relative to the recording head is not particularly limited. For example, the wiping mechanism may include a transporting device for moving the wiper in the Y direction and may move the wiper itself in the Y direction at the time of wiping. Needless to say, both the recording head and the wiper may be moved in the Y direction.

In addition, although the first wiping operation, which is the main wiping operation, is performed by moving the wiper in the Y direction in which the nozzle rows are arranged side by side in the above-described embodiments, the moving direction of the wiper in the first wiping operation is not particularly limited. The moving direction of the wiper may be a direction intersecting the Y direction, for example, the X direction which is the nozzle-row direction. In this manner, when the moving direction of the wiper in the first wiping operation is changed, needless to say, a direction in which the wiping mechanism is moved relative to the recording head in the second wiping operation is changed in accordance with the moving direction of the wiper in the first wiping operation.

Figure 19:
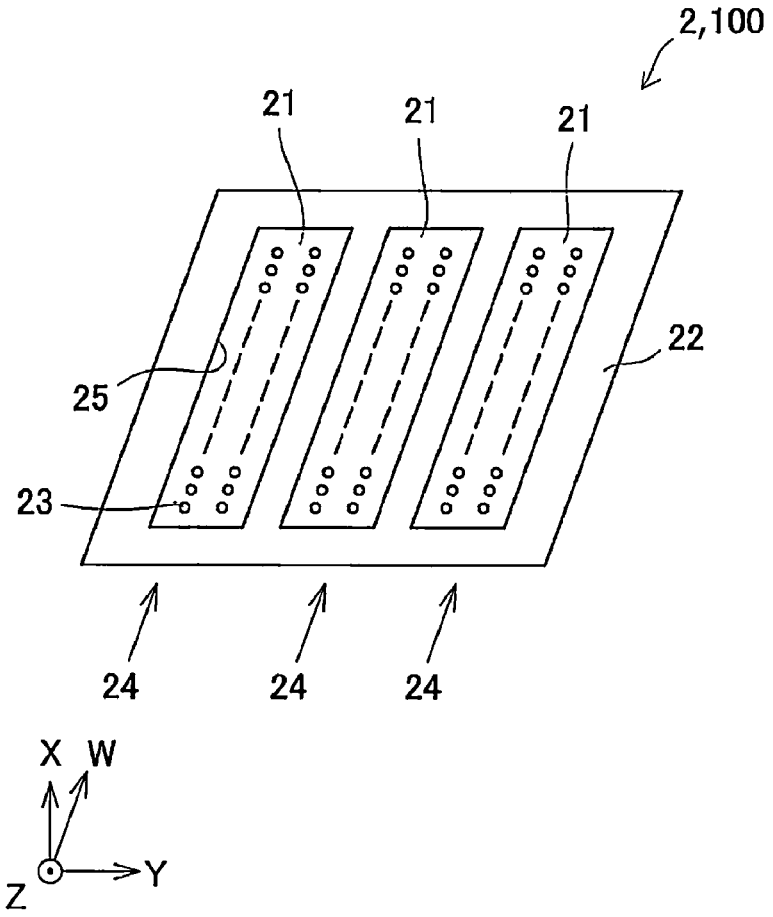
FIG. 19 is a plan view illustrating a wiped surface of a recording head according to another embodiment.

Further, although the second wiper 122 is moved relative to the recording head 2 in the second direction orthogonal to the first direction in Embodiment 2 described above, the second wiper 122 may be moved relative to the recording head 2 in a direction intersecting the first direction. For example, as illustrated in FIG. 19, when the nozzle rows 24 of the recording head 2 are provided in a W direction perpendicular to the Z direction and intersecting both the X direction and the Y direction, which is the first direction, the second wiper 122 may be moved relative to the recording head 2 in the W direction so as to be moved along the nozzle rows 24.

What is claimed is:

1. A liquid ejecting apparatus comprising:

a liquid ejecting head including a wiped surface that includes:

a first region including nozzles configured to eject liquid, and a second region outside the first region;

a wiping mechanism that wipes the wiped surface; and a control unit configured to control the wiping mechanism to:

perform a first wiping operation in which the wiping mechanism moves relative to the wiped surface in a first direction to thereby wipe the first region and the second region, perform a second wiping operation in which the wiping mechanism moves relative to the wiped surface in a direction different from the first direction to thereby wipe a region including an upstream portion of the second region, the upstream portion being arranged, with respect to the first region, in a second direction opposite to the first direction, and perform the second wiping operation before the first wiping operation.

2. The liquid ejecting apparatus according to claim 1, wherein in the second wiping operation, e the first region.

3. The liquid ejecting apparatus according to claim 1, wherein in the second wiping operation, the wiping mechanism moves relative to the wiped surface in the second direction.

4. The liquid ejecting apparatus according to claim 3, wherein the wiping mechanism includes a common wiping member used in the first wiping operation and the second wiping operation.

5. The liquid ejecting apparatus according to claim 3, further comprising a cap configured to be in contact with a sealing section of the wiped surface so as to surround the nozzles, wherein in the second wiping operation, relative movement of the wiping mechanism in the second direction is started from a region within the sealing section.

6. The liquid ejecting apparatus according to claim 1, wherein the wiping mechanism includes a first wiping member used in the first wiping operation and a second wiping member used in the second wiping operation, and in the second wiping operation, the second wiping member moves relative to the upstream portion in a direction intersecting the first direction.

7. The liquid ejecting apparatus according to claim 6, further comprising a cap configured to be in contact with a sealing section of the wiped surface so as to surround the nozzles, wherein the region including the upstream portion of the second region which is wiped in the second wiping operation includes a region within the sealing section.

* * * * *